US011588285B2

(12) United States Patent
Blasick et al.

(10) Patent No.: US 11,588,285 B2
(45) Date of Patent: Feb. 21, 2023

(54) COAXIAL CONNECTOR SYSTEM WITH ADAPTOR

(71) Applicant: TE Connectivity Services GmbH, Schaffhausen (CH)

(72) Inventors: Francis John Blasick, Halifax, PA (US); Keith Edwin Miller, Manheim, PA (US); Denver Harley Wilson, Palmyra, PA (US); Graham Harry Smith, Jr., Mechanicsburg, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 23 days.

(21) Appl. No.: 17/323,258

(22) Filed: May 18, 2021

(65) Prior Publication Data

US 2021/0399506 A1 Dec. 23, 2021

Related U.S. Application Data

(60) Provisional application No. 63/041,186, filed on Jun. 19, 2020.

(51) Int. Cl.
*H01R 24/54* (2011.01)
*H01R 9/05* (2006.01)
(Continued)

(52) U.S. Cl.
CPC ..... *H01R 24/542* (2013.01); *H01R 9/05* (2013.01); *H01R 43/20* (2013.01); *H01R 2103/00* (2013.01)

(58) Field of Classification Search
None
See application file for complete search history.

(56) References Cited

U.S. PATENT DOCUMENTS 9,190,786 B1 * 11/2015 Baumler ..... H01R 13/6315
9,502,836 B2 * 11/2016 Hashiguchi ..... H01R 24/50
(Continued)

FOREIGN PATENT DOCUMENTS

CN 201 774 114 U 3/2011
CN 104 300 299 B 3/2017
(Continued)

OTHER PUBLICATIONS

European Search Report, dated Nov. 12, 2021, EP 21 18 0225, European Application No. 21180225.1-1201.

*Primary Examiner* — Oscar C Jimenez

(57) ABSTRACT

A connector system includes an adapter with a first mating portion, a second mating portion and a transition portion. A continuous outer wall extends across the first mating portion, the transition portion and the second mating potion. A first terminal positioned in the adapter. At least one receptacle has a receptacle mating section and a receptacle transition section. A continuous receptacle outer conductive wall extends across the receptacle mating section and the receptacle transition section. A receptacle inner wall extends perpendicular to the receptacle outer wall. A second terminal is positioned in the at least one receptacle. A retention member is provided in the receptacle mating section. The continuous outer wall and the continuous receptacle outer wall form a grounding shield minimizing signal leakage from the first terminal and the second terminal.

20 Claims, 8 Drawing Sheets

(51) Int. Cl.
*H01R 43/20* (2006.01)
*H01R 103/00* (2006.01)

(56) References Cited

U.S. PATENT DOCUMENTS

| | | | | |
|---|---|---|---|---|
| 2010/0297867 | A1* | 11/2010 | Rosenberger | H01R 24/542 439/345 |
| 2012/0142232 | A1* | 6/2012 | Yin | H01R 13/6315 439/817 |
| 2012/0295478 | A1* | 11/2012 | Mrowka | H01R 24/50 439/578 |
| 2015/0118904 | A1* | 4/2015 | Baechle | H01R 12/91 439/591 |
| 2018/0301834 | A1* | 10/2018 | Dandl | H01R 13/20 |
| 2019/0036240 | A1* | 1/2019 | Imtiaz | H01R 13/6277 |
| 2021/0391663 | A1* | 12/2021 | Xie | H01R 13/112 |
| 2022/0109275 | A1* | 4/2022 | Wild | H05K 1/182 |

FOREIGN PATENT DOCUMENTS

| | | | |
|---|---|---|---|
| CN | 109 217 045 | A | 1/2019 |
| DE | 297 01 944 | U1 | 4/1997 |
| DE | 10 2016 00248 | A1 | 8/2017 |
| WO | 2017 / 059950 | A1 | 4/2017 |

* cited by examiner

COAXIAL CONNECTOR SYSTEM WITH ADAPTOR

FIELD OF THE INVENTION

The present invention relates to a coaxial connector system which improves signal isolation of board to board connections. In particular, the invention relates to a coaxial connector system which has an adapter with a continuous, uninterrupted and solid outer conductor.

BACKGROUND OF THE INVENTION

Due to the increasing complexity of electronic components, it is desirable to fit more components in less space on a circuit board or other substrate. Consequently, the spacing between signal traces and contacts within circuit boards has been reduced, while the number of signal traces and contacts housed in the circuit boards has increased, thereby increasing the need for electrical connectors that are capable of handling higher and higher speeds and to do so with greater and greater densities.

Coaxial connectors and adaptors for providing interconnection between circuit boards is well known in the industry. Such connectors and adaptors may have a subminiature push-on (SMP) interface. The known adapters have tines which provide a mechanical and electrical interconnector with an outer conductive surface of a mating connector. However, as the size of the connectors and adapters decreased to accommodate the increased density of the circuit boards, the tines of the adaptors are required to become smaller and less robust, causing the tines to be prone to damage during mating and shipping. In addition, the tines often allow for unwanted signal leakage between adjacent connectors, thereby requiring the use of conductive gaskets to provide sufficient shielding to minimize cross-talk, as well as other acceptable electrical and mechanical characteristics.

It would, therefore, be beneficial to provide a coaxial connector system which improves signal isolation of board to board connections. In addition, it would be beneficial to provide a coaxial connector system which has an adapter with a continuous, uninterrupted and solid outer conductor to enhance the signal isolation of board to board connections.

SUMMARY OF THE INVENTION

An embodiment is directed to a connector system. The system includes an adapter with a first mating portion, a second mating portion and a transition portion. A continuous outer wall extends across the first mating portion, the transition portion and the second mating potion. A first terminal is positioned in the adapter. At least one receptacle has a receptacle mating section and a receptacle transition section. A continuous receptacle outer conductive wall extends across the receptacle mating section and the receptacle transition section. A receptacle inner wall extends perpendicular to the receptacle outer wall. A second terminal is positioned in the at least one receptacle. A retention member is provided in the receptacle mating section. The continuous outer wall and the continuous receptacle outer wall form a grounding shield minimizing signal leakage from the first terminal and the second terminal.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
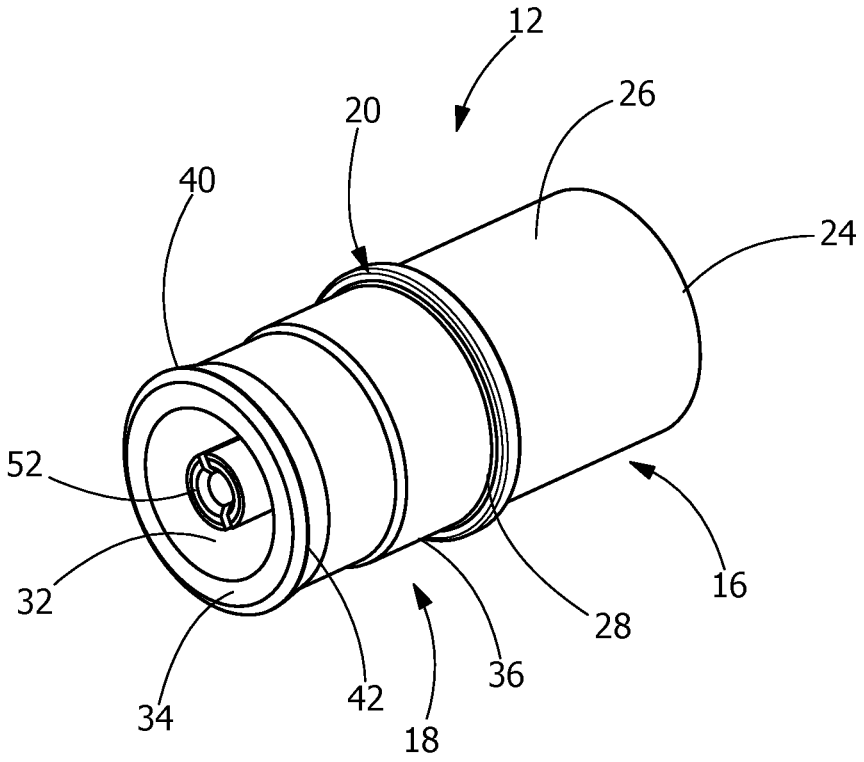
FIG. 1 is a perspective view of an illustrative embodiment of an adapter for use in the illustrative coaxial connector system.
Figure 2:
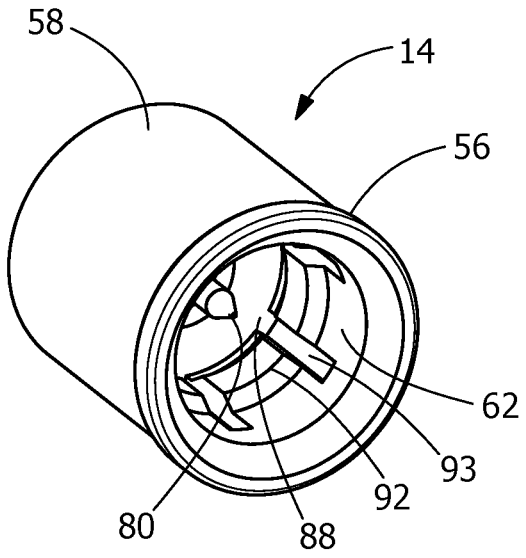
FIG. 2 is a perspective view of an illustrative embodiment of a substrate mounted receptacle for use in the illustrative coaxial connector system.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 4:
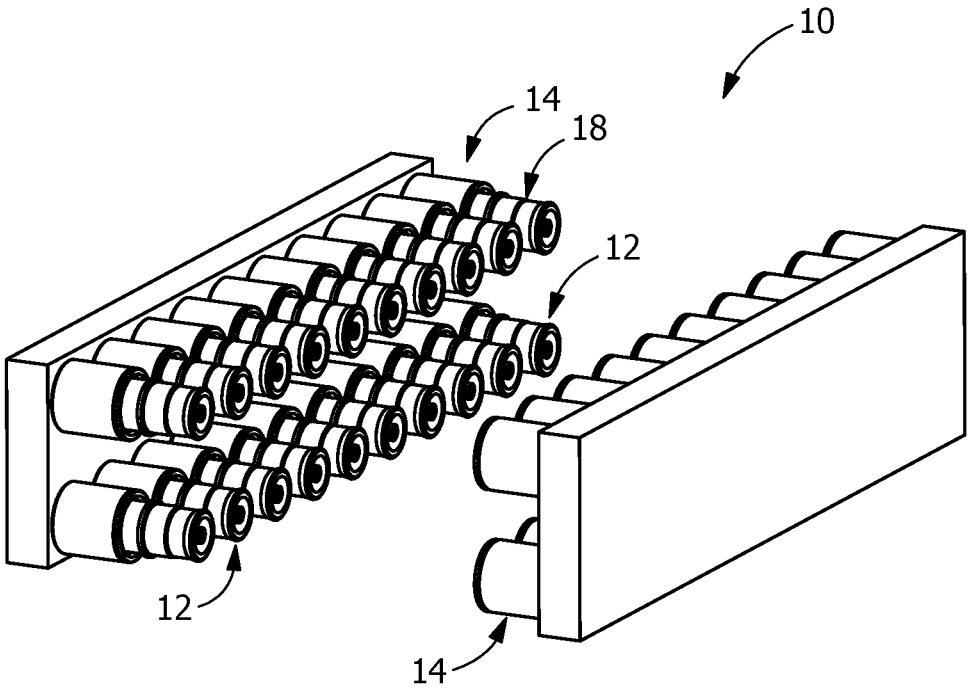
FIG. 4 is a perspective view of the coaxial connector system used to connect two substrates.

The connector system 10, as shown in FIG. 4, includes an adapter 12 and at least one receptacle 14. In the illustrative embodiment shown, two receptacles 14 are shown. Also, in the illustrative embodiment, the receptacle 14 is a substrate or printed circuit board mounted receptacle. However, other types of receptacles may be used.

As shown in FIGS. 5 through 8, the adapter 12 has a first mating portion 16 and a second mating portion 18. A transition portion 20 extends between the first mating portion 16 and the second mating portion 18.

The first mating portion 16 has one or more first terminal receiving cavities 22 which extend from a first mating end 24 to the transition portion 20. An outer conductive wall 26 extends about the first terminal receiving cavity 22. The outer conductive wall 26 is integrally attached to an outer conductive wall 28 of the transition portion 20. A tapered or lead-in surface 30 is provided on the outer wall 26 and extends from the first mating end 24.

The second mating portion 18 has a second terminal receiving cavity 32 which extends from a second mating end 34 to the transition portion 20. An outer conductive wall 36 extends about the second terminal receiving cavity 32. The outer conductive wall 36 is integrally attached to an outer conductive wall 28 of the transition portion 20. An enlarged portion 40 with a securing shoulder 42 is provided on the outer wall 36 and extends from the second mating end 34.

The transition portion 20 has an electrically insulative member 44 which is attached to the outer conductive wall 28 of the transition portion 20. The insulative member 44 is attached to the outer conductive wall 28 by known means, such as, but not limited to, adhesive, interference fit or overmolding. An opening 46 is provided in the insulative member 44. The opening 46 extends from the first terminal receiving cavity 22 of the first mating portion 16 to the second terminal receiving cavity 32 of the second mating portion 18. The opening 46 is positioned in line with a longitudinal axis of the adapter 12.

A terminal 48 is positioned in the adapter 12. The terminal 48 has a first mating section 50, a transition section 52 and a second mating section 54. In the illustrative embodiment shown, the first mating section 50 and the second mating section 54 are female contacts, however, other configurations of the first mating section 50 and/or the second mating section 54 may be used.

The first mating section 50 is positioned in the first terminal receiving cavity 22 of the first mating portion 16 and is spaced from the outer wall 26. The second mating section 54 is positioned in the second terminal receiving cavity 32 of the second mating portion 18 and is spaced from the outer wall 36.

The transition section 52 is positioned in the opening 46 of the transition portion 20. The transition section 52 is secured to the transition section 20 by known means, such as but not limited to, such as, but not limited to, adhesive, interference fit or overmolding.

Figure 6:
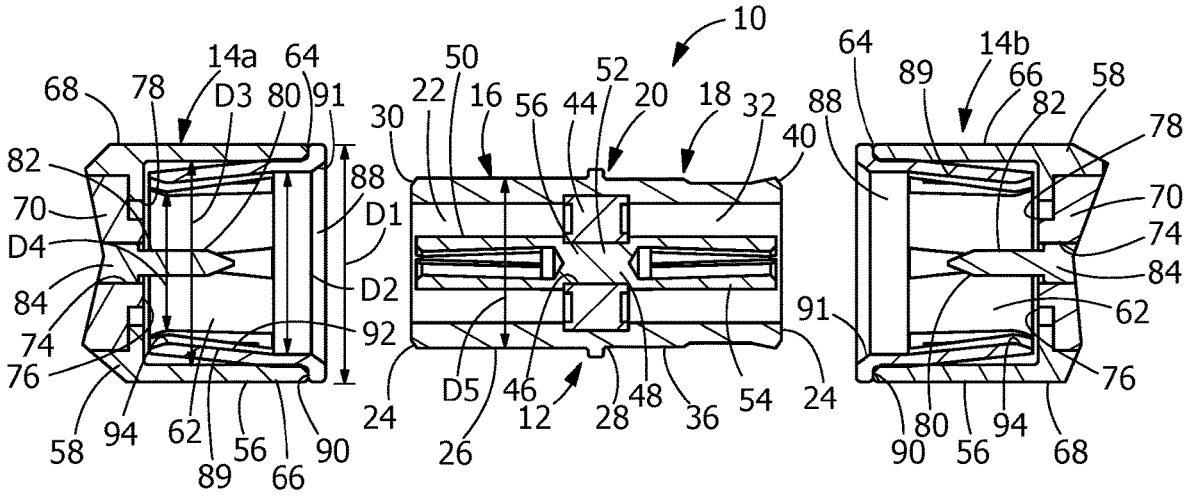
FIG. 6 is a cross-sectional view taken along line 6-6 of FIG. 5.
Figure 8:
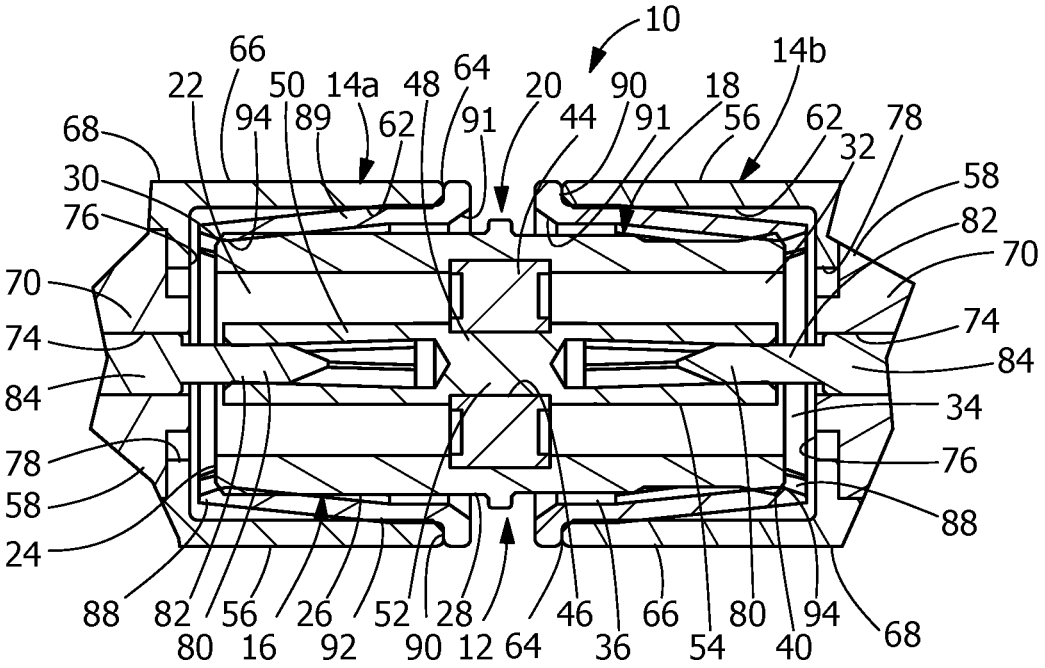
FIG. 8 is a cross-sectional view taken along line 8-8 of FIG. 7.

As shown in FIGS. 6 and 8, each of the receptacles 14 have a mating section 56 and a transition section 58. The mating section 56 has a terminal receiving cavity 62 which extends from a mating end 64 to the transition section 58. An outer conductive wall 66 extends about the terminal receiving cavity 62. The outer conductive wall 66 is integrally attached to an outer conductive wall 68 of the transition section 58.

The transition section 58 has an electrically insulative member 70 which is attached to an outer conductive wall 68 of the transition section 58. The insulative member 70 is attached to the outer conductive wall 58 by known means, such as, but not limited to, adhesive, interference fit, glass hermetic process or overmolding. An opening 74 is provided in the insulative member 70. The insulative member 70 may be, but is not limited to, plastic or glass. The opening 74 extends through the insulative member 70. The opening 74 is positioned in line with a longitudinal axis of the receptacle 14.

An inner wall 76 extends perpendicular to the outer wall 66. An opening 78 is provided in the inner wall 76. The opening 78 is positioned in line with the opening 74 of the insulative member 70.

A terminal 80 is positioned in each of the receptacles 14. The terminal 80 has a first mating section 82, a transition section 84 and a second mating section (not shown). The second mating section is provided in electrical engagement with another component, such as, but not limited to, a printed circuit board.

In the illustrative embodiment shown, the first mating section 82 is a male contact, however, other configurations of the first mating section 82 and/or the second mating section 54 may be used. The first mating section 82 is positioned in the terminal receiving cavity 62 of the mating section 56 and is spaced from the outer wall 66.

The transition section 84 is positioned in the opening 78 of the transition section 58 and in the opening 74 of the insulative member 70. The transition section 84 of the terminal 80 is secured to the transition section 84 of the receptacle 14 by known means, such as but not limited to, such as, but not limited to, adhesive, interference fit, glass hermetic process or overmolding.

Figure 3:
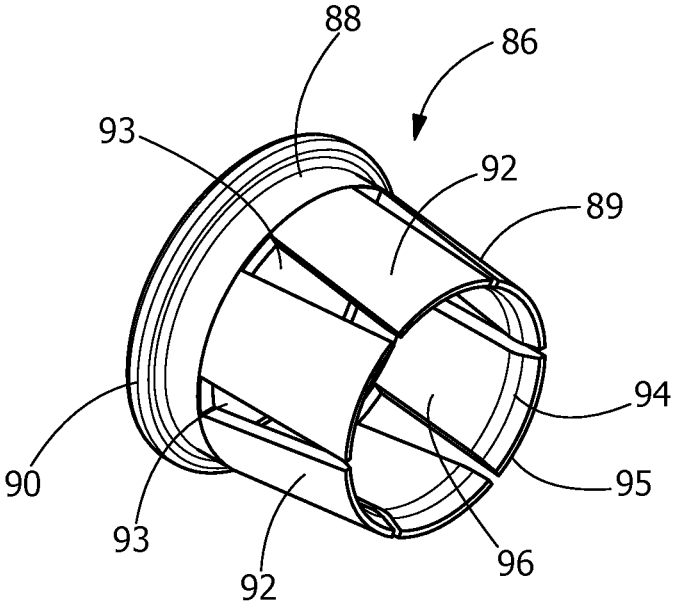
FIG. 3 is a perspective view of an illustrative embodiment of an inner spring for use in the illustrative coaxial connector system.

As shown in FIGS. 6 and 8, an inner spring or retention member 86 is provide in the terminal receiving cavity 62 of the mating section 56 of the receptacle 14. As shown in FIGS. 3, 6 and 8, the inner spring 86 has a base section 88 and a securing section 89. The base section 88 is provided about the circumference of the inner spring 86. The base section 88 has a positioning shoulder 90 and an angled or lead-in surface 91.

The securing section 89 has resilient contact arms 92 which extend from the base in a direction away from the lead-in surface 91. The contact arms 92 are spaced apart by slots 93. In the illustrative embodiment shown, six contact arms 92 are provided, however, other numbers of contact arms may be provided. The contact arms 92 have sloped or locking surfaces 94 provided proximate free ends 95 thereof. An adapter receiving opening 96 extends through the base section 88 and the securing section 89 of the inner spring 86.

As shown in FIG. 6, the base section 88 of the inner spring 86 has an outer diameter D1 which is greater than an inner diameter D2 of the terminal receiving cavity 62 of the mating section 56 of the receptacle 14. The securing section 89 of the inner spring 86 has an outer diameter D3 which is smaller than the inner diameter D2 of the terminal receiving cavity 62 of the mating section 56 of the receptacle 14.

The adapter receiving opening 96 of the inner spring 86 has a diameter D4 at the base section 88 which is slightly larger, but approximately equal to the outside diameter D5 of either the first mating portion 16 or the second mating portion 18 of the adapter 12. The adapter receiving opening 96 of the inner spring 86 has a diameter D4 at free ends 95 of the contact arms 92 of the securing section 89 which is smaller than the outside diameter D5 of either the first mating portion 16 or the second mating portion 18 of the adapter 12.

Figure 5:
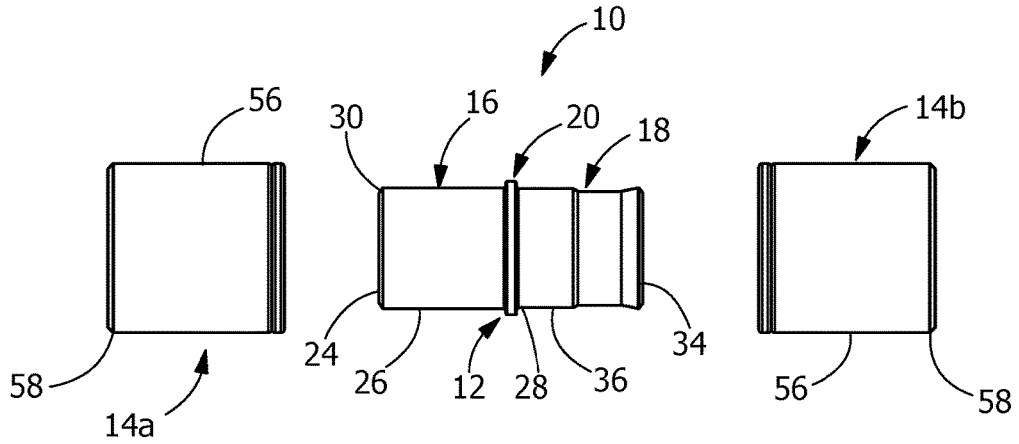
FIG. 5 is a front view of the adapter of FIG. 1 positioned between two substrate mounted receptacles of FIG. 2, the adapter is shown prior to insertion into the substrate mounted receptacles.
Figure 7:
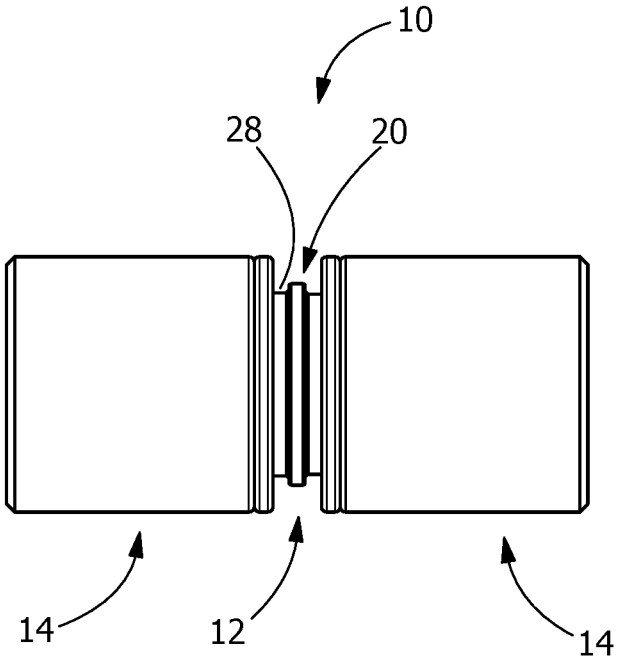
FIG. 7 is a front view of the adapter and the substrate mounted receptacles of FIG. 5, the adapter is shown inserted into the substrate mounted receptacles.

In use, the adapter 12 and receptacles 14 are moved from the open or non-inserted position shown in FIGS. 5 and 6 to the closed or inserted position shown in FIGS. 7 and 8.

In the closed position, the outer wall 26 of the first mating portion 16 of the adapter 12 is in mechanical and electrical engagement with the resilient contact arms 92 of the inner spring 86 of a first receptacle 14*a*. As the diameter D5 of the first mating portion 16 is greater than the diameter D6 of the securing section 89, the contact arms 92 are elastically displaced, causing the free ends 95 of the contact arms 82 to exert a normal force on the first mating portion 16. In addition, the contact arms 92, proximate the base section 88, and the base section 88 are provided in electrical and mechanical engagement with the outer wall 66 of the mating section 56 of the receptacle 14*a*.

Consequently, an electrical pathway is provided between the outer wall 26 of the first mating portion 16 of the adapter 12, the resilient contact arms 92 of the inner spring 86 of a first receptacle 14*a* and the outer wall 66 of the mating section 56 of the receptacle 14*a*. In addition, the contact arms 92 exert a force on the first mating portion 16, a frictional fit is provided between the contact arms 92 and the first mating portion 16 to retain the first mating portion 16 in the receptacle 14*a*.

In the closed position, the outer wall 36 of the second mating portion 18 of the adapter 12 is in mechanical and electrical engagement with the resilient contact arms 92 of the inner spring 86 of a second receptacle 14*b*. As the diameter D5 of the second mating portion 18 is greater than the diameter D6 of the securing section 89, the contact arms 92 are elastically displaced, causing the locking surfaces 94 provided proximate free ends 95 of the contact arms 82 to engage and exert a force on the securing shoulder 42 of the second mating portion 18. In addition, the contact arms 92, proximate the base section 88, and the base section 88 are provided in electrical and mechanical engagement with the outer wall 66 of the mating section 56 of the receptacle 14*b*.

Consequently, an electrical pathway is provided between the outer wall 36 of the second mating portion 18 of the adapter 12, the resilient contact arms 92 of the inner spring 86 of a second receptacle 14*b* and the outer wall 66 of the mating section 56 of the receptacle 14*b*. In addition, the contact arms 92 exert a force on the second mating portion 18, and as the locking surfaces 94 of the contact arms 82 engage the securing shoulder 42 of the second mating portion 18, an interference fit is provided between the contact arms 92 and the second mating portion 18 to retain the second mating portion 18 in the receptacle 14*b*.

In the closed position, the first mating section 50 of the terminal 48 is provided in electrical and mechanical engagement with the terminal 80 of the first receptacle 14*a*. In addition, the second mating section 52 of the terminal 48 is provided in electrical and mechanical engagement with the terminal 80 of the second receptacle 14*b*.

The mating of the terminal 80 of the first receptacle 14*a*, the terminal 48 of the adapter 14 and the terminal 80 of the first receptacle 14*b* provide an electrical pathway for the signal transmission. The mating of the outer wall 36 of the second mating portion 18 of the adapter 12, the resilient contact arms 92 of the inner spring 86 of a second receptacle 14*b* and the outer wall 66 of the mating section 56 of the receptacle 14*b* provide an electrical pathway for the ground transmissions. As the contact arms 92 extend about the entire circumference of the first mating portion 16 of the adapter 12, an effective grounding shield is provided to allow for proper and adequate electrical isolation between terminals 80.

By positioning the inner spring 86 in the receptacle 14, the adapter 12 can have continuous, uninterrupted and solid outer walls 26, 36, thereby eliminating tines and slots needed for existing adapters, allowing the adapter 12 to be more robust than adapters currently available. In addition, as the outer walls 26, 36 are continuous, uninterrupted and solid, the shielding or isolation of the adapter 12 and the system 10 is improved over known adapters which have spaces provided in the outer walls.

Figure 9:
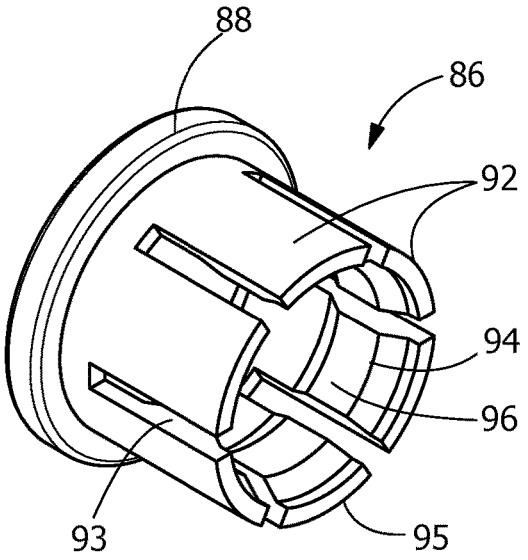
FIG. 9 is a perspective view of an alternate illustrative embodiment of an inner spring for use in the illustrative coaxial connector system.
Figure 10:
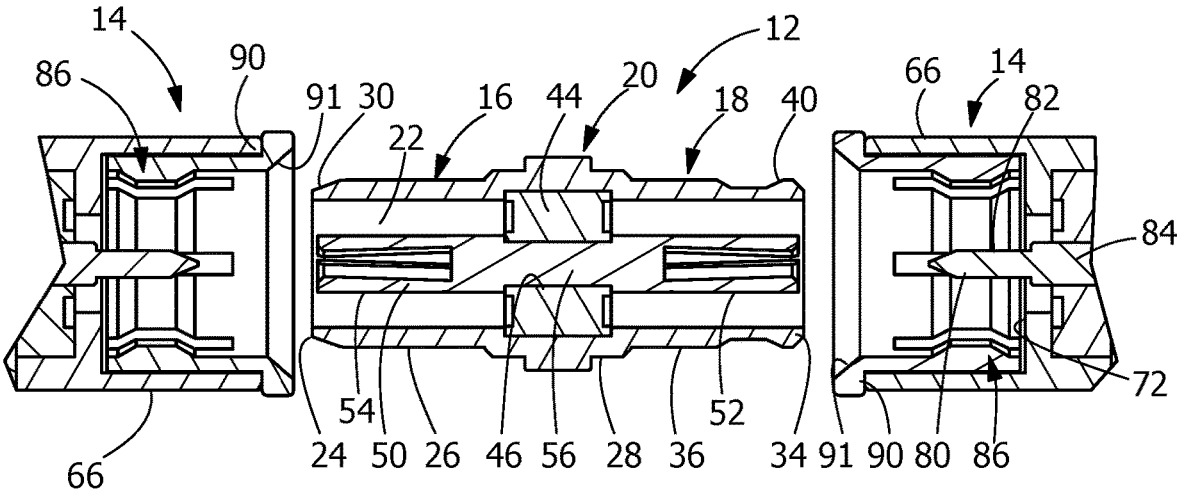
FIG. 10 is a cross-sectional view of the adapter positioned between two substate mounted receptacles which includes the inner spring of FIG. 9, the adapter is shown prior to insertion into the substrate mounted receptacles.
Figure 11:
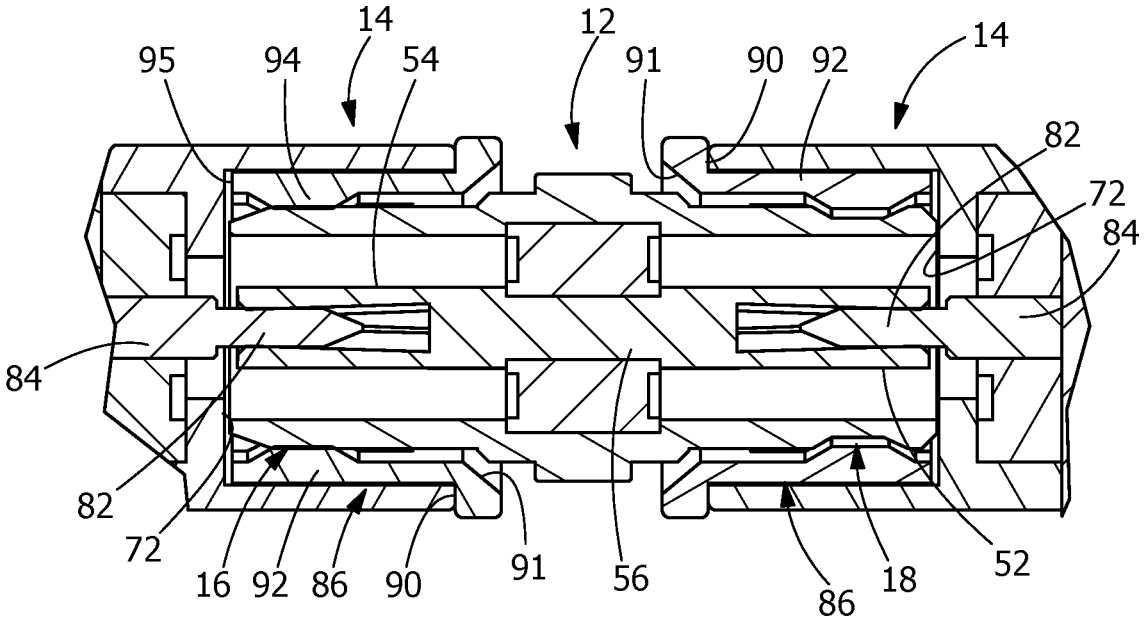
FIG. 11 is a cross-sectional view of the adapter and the substate mounted receptacles of FIG. 10, the adapter is shown inserted into the substrate mounted receptacles.

FIGS. 9 through 11 illustrate a second alternate illustrative embodiment of the invention. In this embodiment, the contact arms 92 of the inner spring 86 have a larger locking area 94 provided proximate the free ends 95. In addition, the contact arms 92 have a larger cross-sectional area and a larger mass to facilitate the flow of the electrical signal thereacross. The operation of the inner spring 86 and the adapter 12 and receptacles 14 are similar to that described above.

Figure 12:
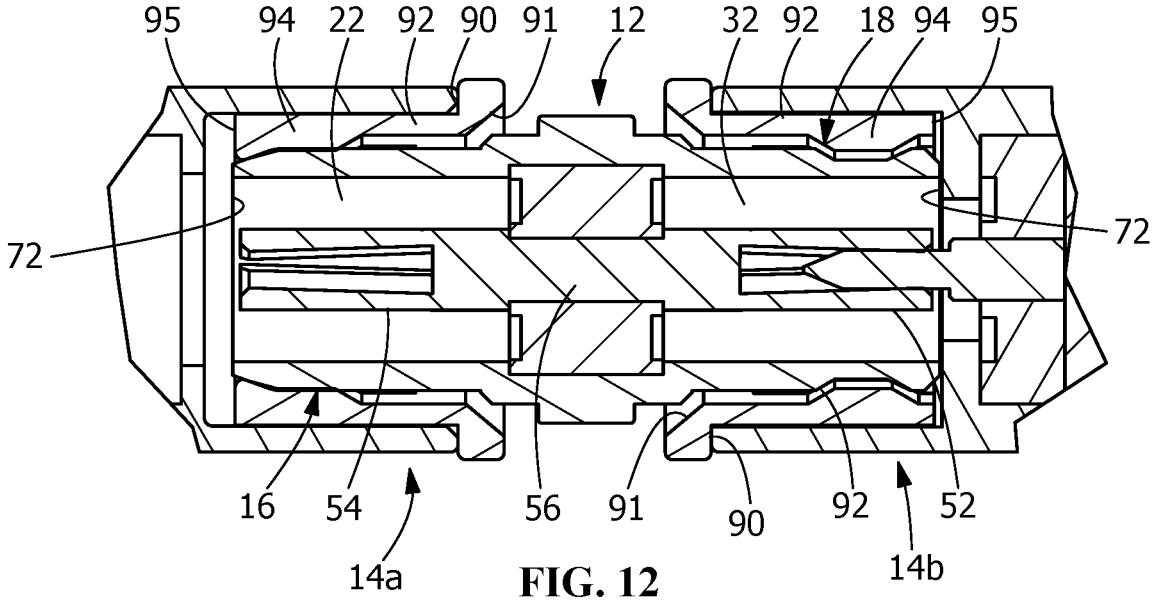
FIG. 12 is a cross-sectional view of the adapter positioned between two substate mounted receptacles which includes another alternative inner spring, the adapter is shown inserted into the substrate mounted receptacles.

FIG. 12 illustrate a third alternate illustrative embodiment of the invention. In this embodiment, the contact arms 92 of the inner spring 86 have a larger locking area 94 provided proximate the free ends 95. In addition, the contact arms 92 have a larger cross-sectional area and a larger mass to facilitate the flow of the electrical signal thereacross. In this embodiment, the configuration of the locking area 94 of the contact arms 92 in one receptacle 14*a* are configured different than the contact arms 92 in the other receptacle adapter 12. The operation of the inner spring 86 and the adapter 24 and receptacles 14 are similar to that described above.

The larger locking area 94 allows the connector system to have better impedance control when the parts are not fully mated. The locking area 94 occupies space, which in other embodiments contains air. Replacing the air pockets with metal from the locking area 94 allows for better impedance control.

Figure 13:
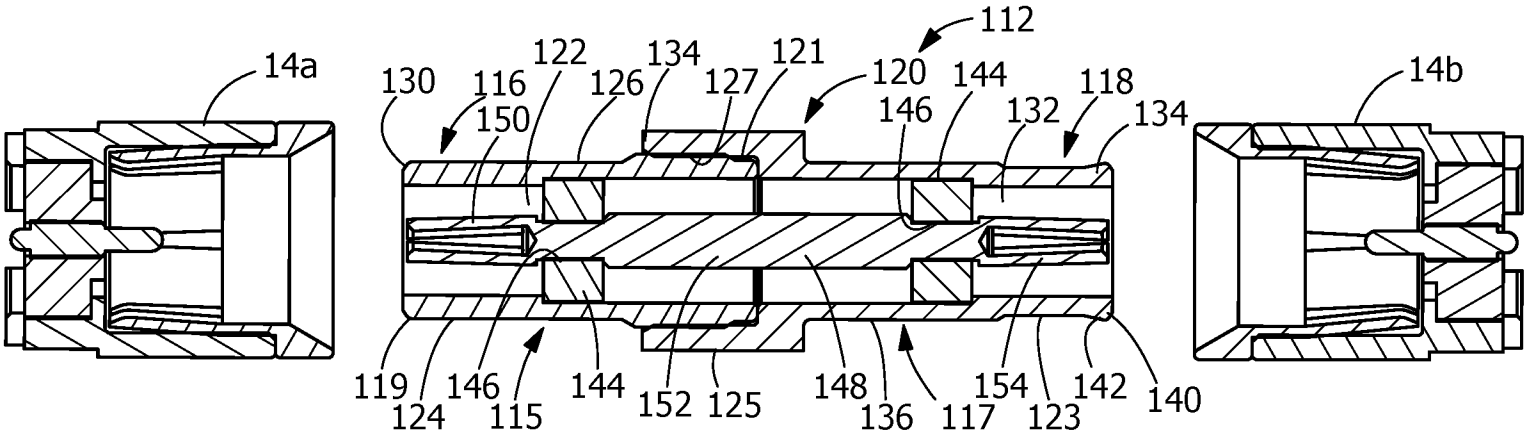
FIG. 13 is a cross-sectional view of another alternate adapter positioned between two substate mounted receptacles, the adapter is shown prior to insertion into the substrate mounted receptacles.
Figure 14:
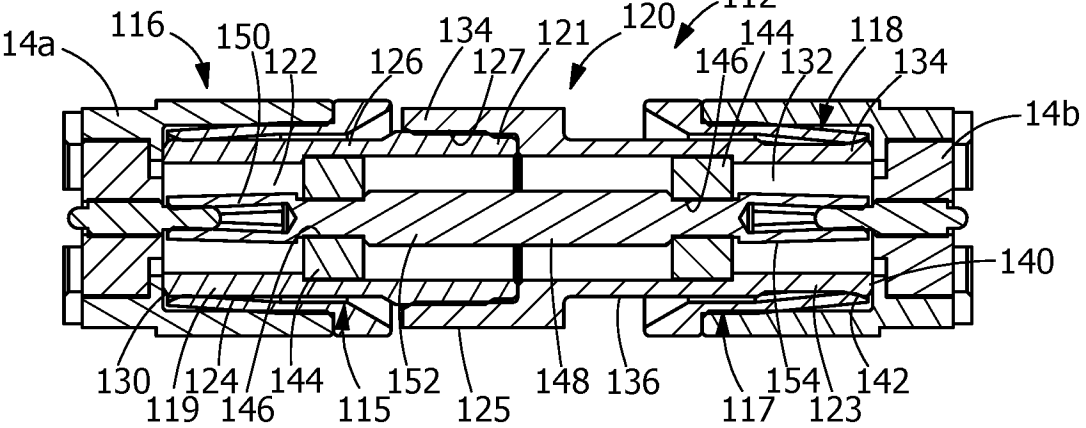
FIG. 14 is a cross-sectional view of the adapter of FIG. 13 positioned between two substate mounted receptacles, the adapter is shown inserted into the substrate mounted receptacles.

Referring to FIGS. 13 and 14, an alternate adapter 112 is shown. The adapter 112 has a first mating portion 116 and a second mating portion 118. A transition portion 120 extends between the first mating portion 116 and the second mating portion 118.

The adapter 112 is longer than the adapter 12 and has a first housing 115 and a second housing 117. The first housing 115 has a first end 119 and a second end 121. The second housing 117 has a first end 123 and a second end 125.

The first mating portion 116 is provided on the first housing 115 and extends from the first end 119 in a direction toward the second end 121. The first mating portion 116 has one or more first terminal receiving cavities 122 which extend from a first mating end 124 of the first mating portion 116 to the transition portion 120. In the embodiment shown, the first end 119 of the first housing 115 is the same as the first mating end 124 of the first mating portion 116. An outer conductive wall 126 of the first housing 115 extends about the first terminal receiving cavity 122. The outer conductive wall 126 also extends to a portion of the transition portion 120. A tapered or lead-in surface 130 is provided on the outer wall 126 and extends from the first mating end 124.

The second mating portion 118 is provided on the second housing 117 and extends from the first end 123 in a direction toward the second end 125. The second mating portion 118 has a second terminal receiving cavity 132 which extends from a second mating end 134 to the transition portion 120. In the embodiment shown, the first end 123 of the second housing 117 is the same as a second mating end 134 of the second mating portion 118. An outer conductive wall 136 of the second housing 117 extends about the second terminal receiving cavity 132. The outer conductive wall 136 also extends to a portion of the transition portion 120. An enlarged portion 140 with a securing shoulder 142 is provided on the outer wall 136 and extends from the second mating end 134.

In the transition portion 120, the portion of the outer conductive wall 126 of the first housing 115 which extends into the transition portion 120 is positioned in electrical and mechanical engagement with the portion of the outer conductive wall 136 of the second housing 117 which extends into the transition portion 120. In the embodiment shown, the outer conductive wall 126 is inserted into a receiving cavity 127 of the outer conductive wall 136. The outer conductive wall 126 is retained in the receiving cavity 127 by an interference fit or other means which allow the outer conductive wall 126 to be retained in electrical engagement with the outer conductive wall 136. The use of the first housing 115 with the outer conductive wall 126 and the second housing 117 with the outer conductive wall 136 provides a continuous, uninterrupted and solid outer wall 126, 136, thereby eliminating tines and slots needed for existing adapters, allowing the adapter 112 to be more robust than adapters currently available. In addition, as the outer walls 126, 136 are continuous, uninterrupted and solid, the shielding or isolation of the adapter 112 and the system is improved over known adapters which have spaces provided in the outer walls.

The transition portion 120 has one or more electrically insulative member 144 which are attached to the outer conductive wall 128 of the transition portion 120. The insulative members 144 are attached to the outer conductive wall 128 by known means, such as, but not limited to, adhesive, interference fit or overmolding. Openings 146 is provided in the insulative members 144. The openings 46 are positioned in line with a longitudinal axis of the adapter 112.

A terminal 148 is positioned in the adapter 112. The terminal 148 has a first mating section 150, a transition section 152 and a second mating section 154. In the illustrative embodiment shown, the first mating section 150 and the second mating section 154 are female contacts, however, other configurations of the first mating section 150 and/or the second mating section 154 may be used.

The first mating section 150 is positioned in the first terminal receiving cavity 122 of the first mating portion 116 and is spaced from the outer wall 126. The second mating section 154 is positioned in the second terminal receiving cavity 132 of the second mating portion 118 and is spaced from the outer wall 136.

The transition section 152 extends through the openings 146 of the insulative members 144 and through the transition portion 120. The transition section 152 is secured to the insulative members 144 and the transition section 120 by known means, such as but not limited to, such as, but not limited to, adhesive, interference fit or overmolding.

Figure 15:
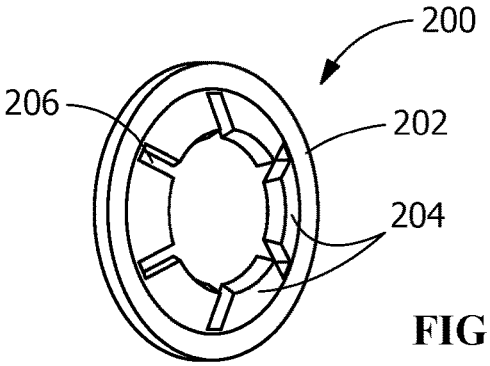
FIG. 15 is a perspective view of an illustrative embodiment of a second spring for use in the illustrative coaxial connector system.
Figure 16:
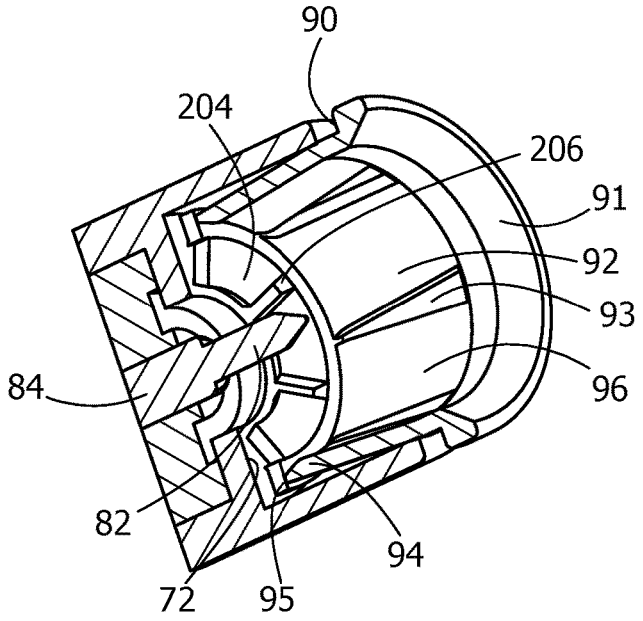
FIG. 16 is a perspective cross-sectional view of the second spring of FIG. 12 positioned in the substrate mounted receptacle.

Referring to FIGS. 15 and 16, a secondary spring 200 may be provided in the terminal receiving cavity 62 between the wall 76 and the free ends 95 of the contact arms 96 of the spring 86. The secondary spring 200 has a base 202 with contact arms 204 extending therefrom. The contact arms 204 are spaced apart by slots 206. When inserted into the terminal receiving cavity 62, the contact arms 204 engage the wall 76 and the base 202 engages the free ends 95 of the contact arms 92 of the spring 86. The secondary spring 200 causes the spring 86 to be more precisely positioned in the terminal receiving cavity of the receptacle 14. The purpose of the secondary spring 200 is to maintain electrical contact between the end 24, 34 of the adapter 12 and the bottom wall 76 of the receiving cavity 62 if the substrates to which the receptacles 14 are attached are separated slightly.

Figure 17:
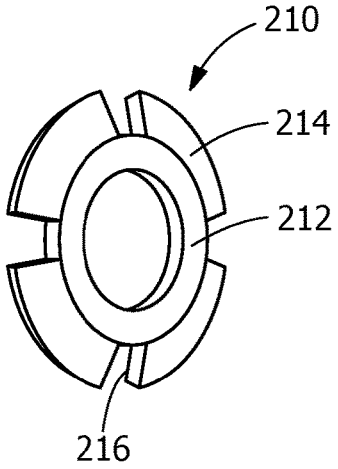
FIG. 17 is a perspective view of an alternate illustrative embodiment of a second spring for use in the illustrative coaxial connector system.

FIG. 17 illustrates an alternate illustrative secondary spring 210. In this embodiment the contact arms 214 extend outward from the base 212. Slots 216 are provided between the contact arms 214. When inserted into the terminal receiving cavity 62, the base 212 engages the wall 76 and the contact arms 214 engage the free ends 95 of the contact arms 92 of the spring 86. The operation of the secondary spring 210 is similar to the operation of the spring 200.

Figure 18:
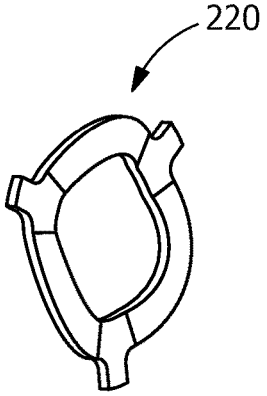
FIG. 18 is a perspective view of a second alternate illustrative embodiment of a second spring for use in the illustrative coaxial connector system.

FIG. 18 illustrates a second alternate illustrative secondary spring 220. The operation of the secondary spring 220 is similar to the operation of the spring 200.

The invention provides a connector system which as a bullet or adapter with a continuous, uninterrupted and solid outer shell, free of tines and slots, thereby allowing very little signal leakage. This allows the connectors to be placed next to each other without crosstalk concerns This allows the connectors to be placed next to each other without crosstalk concerns. In addition, as the outer shell is continuous, uninterrupted and solid, the adapter has a very robust configuration. This allows the connector to be more rugged than known SMPS connector system.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector system comprising:

an adapter having a first mating portion, a second mating portion and a transition portion, a continuous outer wall extending across the first mating portion, the transition portion and the second mating potion;

a first terminal positioned in the adapter;

at least one receptacle having a receptacle mating section and a receptacle transition section, a continuous receptacle outer conductive wall extending across the receptacle mating section and the receptacle transition section, a receptacle inner wall extending perpendicular to the receptacle outer wall;

a second terminal positioned in the at least one receptacle;

a resilient retention member provided in the receptacle mating section;

a secondary spring provided in the receptacle mating section between the receptacle inner wall and free ends of the resilient retention member;

wherein the continuous outer wall and the continuous receptacle outer wall form a grounding shield minimizing signal leakage from the first terminal and the second terminal.

2. The connector system of claim 1, wherein the first mating portion has a first terminal receiving cavity which extends from a first mating end of the first mating portion to the transition portion.

3. The connector system as recited in claim 2, wherein the second mating portion has a second terminal receiving cavity which extends from a second mating end of the second mating end to the transition portion.

4. The connector system as recited in claim 3, wherein an enlarged portion with a securing shoulder is provided on the continuous outer wall and extends from the second mating end.

5. The connector system as recited in claim 4, wherein the transition portion has an electrically insulative member, an insulative member opening is provided in the insulative member, the insulative member opening extends from the first terminal receiving cavity of the first mating portion to the second terminal receiving cavity of the second mating portion, the insulative member opening is positioned in line with a longitudinal axis of the adapter.

6. The connector system as recited in claim 5, wherein the first terminal has a first mating section, a transition section and a second mating section, the first mating section is positioned in the first terminal receiving cavity of the first mating portion and is spaced from the continuous outer wall, the second mating section is positioned in the second terminal receiving cavity of the second mating portion and is spaced from the continuous outer wall.

7. The connector system as recited in claim 6, wherein the transition section is positioned in the insulative member opening of the transition portion.

8. The connector system as recited in claim 1, wherein the receptacle mating section has a receptacle terminal receiving cavity which extends from a receptacle mating end of the receptacle mating section to the receptacle transition section.

9. The connector system as recited in claim 8, where the receptacle transition section has a receptacle electrically insulative member, the receptacle insulative member has a receptacle insulative member opening which extends through the receptacle insulative member, the receptacle insulative member opening is positioned in line with a longitudinal axis of the at least one receptacle.

10. The connector system as recited in claim 9, wherein, the second terminal has a second terminal first mating section and a second terminal transition section.

11. The connector system as recited in claim 10, wherein the second terminal first mating section is positioned in the receptacle terminal receiving cavity of the receptacle mating section and is spaced from the continuous receptacle outer wall.

12. The connector system as recited in claim 11, wherein the second terminal transition section is positioned in the receptacle insulative member opening of the receptacle transition section and in the insulative member opening of the receptacle insulative member.

13. The connector system as recited in claim 1, wherein the resilient retention member is an inner spring.

14. The connector system as recited in claim 13, wherein the inner spring has a base section and a securing section, the base section is provided about the circumference of the inner spring, the base section has a positioning shoulder and an angled surface.

15. The connector system as recited in claim 14, where the securing section has resilient contact arms which extend from the base section in a direction away from the angled surface, the contact arms are spaced apart by slots.

16. The connector system as recited in claim 15, wherein the resilient contact arms have locking surfaces provided proximate free ends of the resilient contact arms, an adapter receiving opening extends through the base section and the securing section.

17. The connector system as recited in claim 13, wherein the secondary spring is provided in a terminal receiving cavity of the receptacle mating section.

18. The connector system as recited in claim 1, wherein the adapter has a first housing and a second housing.

19. The connector system as recited in claim 18, wherein the conductive wall of the adapter has an outer conductive wall of the first housing which extends about the first terminal receiving cavity and into the transition portion, and an outer conductive wall of the second housing which extends about the second terminal receiving cavity and into the transition portion.

20. The connector system as recited in claim 19, wherein the outer conductive wall of the first housing is inserted into a receiving cavity of the outer conductive wall of the second housing to position the outer conductive wall of the first housing in electrical engagement with the outer conductive wall of the second housing, wherein the conductive wall of the adapter is a continuous, uninterrupted and solid outer wall which provides shielding.

* * * * *